United States Patent [19]

Li et al.

[11] 4,024,610

[45] May 24, 1977

[54] METHOD AND APPARATUS FOR TEXTURIZING CONTINUOUS FILAMENTS

[75] Inventors: Hsin Lang Li, Parsippany; Alfred Louis Liland, Wharton; Hendrikus Johan Oswald, Morristown, all of N.J.

[73] Assignee: Allied Chemical Corporation, Morris Township, N.J.

[22] Filed: Oct. 2, 1975

[21] Appl. No.: 619,086

[52] U.S. Cl. ..... 28/1.3; 28/1.4; 28/1.6; 28/72.11; 28/72.12; 28/72.14

[51] Int. Cl.[2] ..... D02G 1/20; D02G 1/16; D02G 1/12

[58] Field of Search ..... 28/1.3, 1.4, 1.6, 72.11, 28/72.12, 72.14, 254, 258, 267, 256, 257

[56] References Cited

UNITED STATES PATENTS

| | | | |
|---|---|---|---|
| 2,734,228 | 2/1956 | Hay | 28/1.6 |
| 3,156,028 | 11/1964 | Weiss et al. | 28/1.6 X |
| 3,438,101 | 4/1969 | Le Noir et al. | 28/1.6 |
| 3,859,697 | 1/1975 | Guenther | 28/1.4 |
| 3,861,133 | 1/1975 | Frankfort et al. | 28/72.12 |
| 3,899,811 | 8/1975 | Bauch | 28/72.12 |

FOREIGN PATENTS OR APPLICATIONS

| | | | |
|---|---|---|---|
| 1,198,035 | 7/1970 | United Kingdom | 28/1.6 |

*Primary Examiner*—Louis K. Rimrodt
*Attorney, Agent, or Firm*—Ernest D. Buff; Arthur J. Plantamura

[57] ABSTRACT

Continuous filaments, e.g. in the form of yarn, are fed by aspiration into a stream of heated fluid. The stream containing the filaments is directed into contact with a barrier disposed within a chamber at a force sufficient to initiate crimping of the filaments. A major portion of the fluid is separated from the filaments and expelled from the chamber. The filaments are transported through the chamber by continuous movement of a surface therein at sufficient velocity to cause overfeeding of the filaments, whereby the filaments are forced against a mass thereof producing crimps therein. One or more streams of heated fluid are then contacted with the mass of filaments to set the crimps. The crimped filaments emerge from the chamber through an outlet opening therein.

18 Claims, 4 Drawing Figures

METHOD AND APPARATUS FOR TEXTURIZING CONTINUOUS FILAMENTS

BACKGROUND OF THE INVENTION

1. FIELD OF THE INVENTION

This invention relates to method and apparatus for preparing crimped fibrous structures and more particularly to means for crimping textile fibrous materials such as, filaments, yarn, tow for staple fibers and the like.

2. DESCRIPTION OF THE PRIOR ART

In the apparatus conventionally used to crimp textile strands to increase their bulkiness, a tow of continuous filaments is forced by fluid energy against a mass of tow within a chamber, and emerges in crimped form from the chamber when the pressure on the mass exceeds a certain limit. The number of crimps produced by such apparatus per inch of the filaments, as well as the skein shrinkage or crimp contraction level produced in the filaments, is ordinarily too low for economical processing of the filaments into high quality knitting yarns, fabrics, high stretch yarns and the like. Higher fluid temperatures, as in the order of 400° C., increase crimping levels but decrease orientation of the filaments, reducing their tensile strength and/or dyeing uniformity. Increasing the mass flow of the fluid to heat the filaments at lower fluid temperatures produces turbulence within the chamber, destroying incipient crimps and decreasing the skein shrinkage level of the filaments.

SUMMARY OF THE INVENTION

The present invention provides a method and apparatus whereby continuous filaments are crimped at relatively low temperature and in an economical and highly reliable manner. Continuous filaments, e.g. in the form of yarn, are fed by aspiration into a stream of heated fluid. The combined fluid and filaments are directed into contact with barrier means disposed within a chamber, the force of contact being sufficient to initiate crimping of the filaments. Upon contact with the barrier means, the major portion of the fluid is separated from the filaments and expelled from the chamber. The filaments are transported through the chamber by continuous movement of a surface therein to cause overfeeding of the filaments into the chamber. Due to such overfeeding, the filaments are forced against a mass thereof within a zone of compaction in the chamber, producing crimps therein. One or more streams of heated fluid are then contacted with the mass of filaments to set the crimps. The chamber has an inlet opening for receiving the filaments therefrom, fluid jet heating means for contacting the mass with heated fluid and fluid escape means for separating the fluid from the filaments and expelling it from the chamber. A carrier means associated with the chamber forms the continuously moving surface.

It has been found that contacting the mass of filaments with heated fluid to set the crimps therein increases the number of crimps per inch of the filaments, as well as the memory thereof. The flexibility of the filaments increases and crimp sharpness is improved. Due to he increased flexibility and crimp sharpness created in the filaments during setting, the pressure and temperature required for crimping are surprisingly low, with the result that the crimps are produced in a highly efficient manner. Crimping levels are unusually high, i.e. in excess of 40 crimps per inch and typically as high as 50 crimps per inch or more. Filament degradation is minimized, skein shrinkage level is greatly improved, i.e. in excess of 45 percent, and uniformity and consistency of crimp are easily controlled. Thus the texturized filaments of this invention permit production of high-bulk and stretch knitting yarns at higher speed and lower temperatures and costs than those incurred by conventional operations wherein the filaments are crimped using a single heating stage.

BRIEF DESCRIPTION OF THE DRAWING

The invention will be more fully understood and further advantages will become apparent when reference is made to the following detailed description and the accompanying drawings in which.

DESCRIPTION OF THE PREFERRED EMBODIMENT

The crimping apparatus of this invention comprises a chamber having inlet, outlet fluid jet and fluid escape means. Such chamber may be fabricated in a number of diverse sizes and configurations. For illustrative purposes, the invention is described in connection with a chamber having an arcuate configuration. It will be readily appreciated, however, that chambers having linear as well as curvilinear configurations fall within the scope of the present invention.

Figure 1:
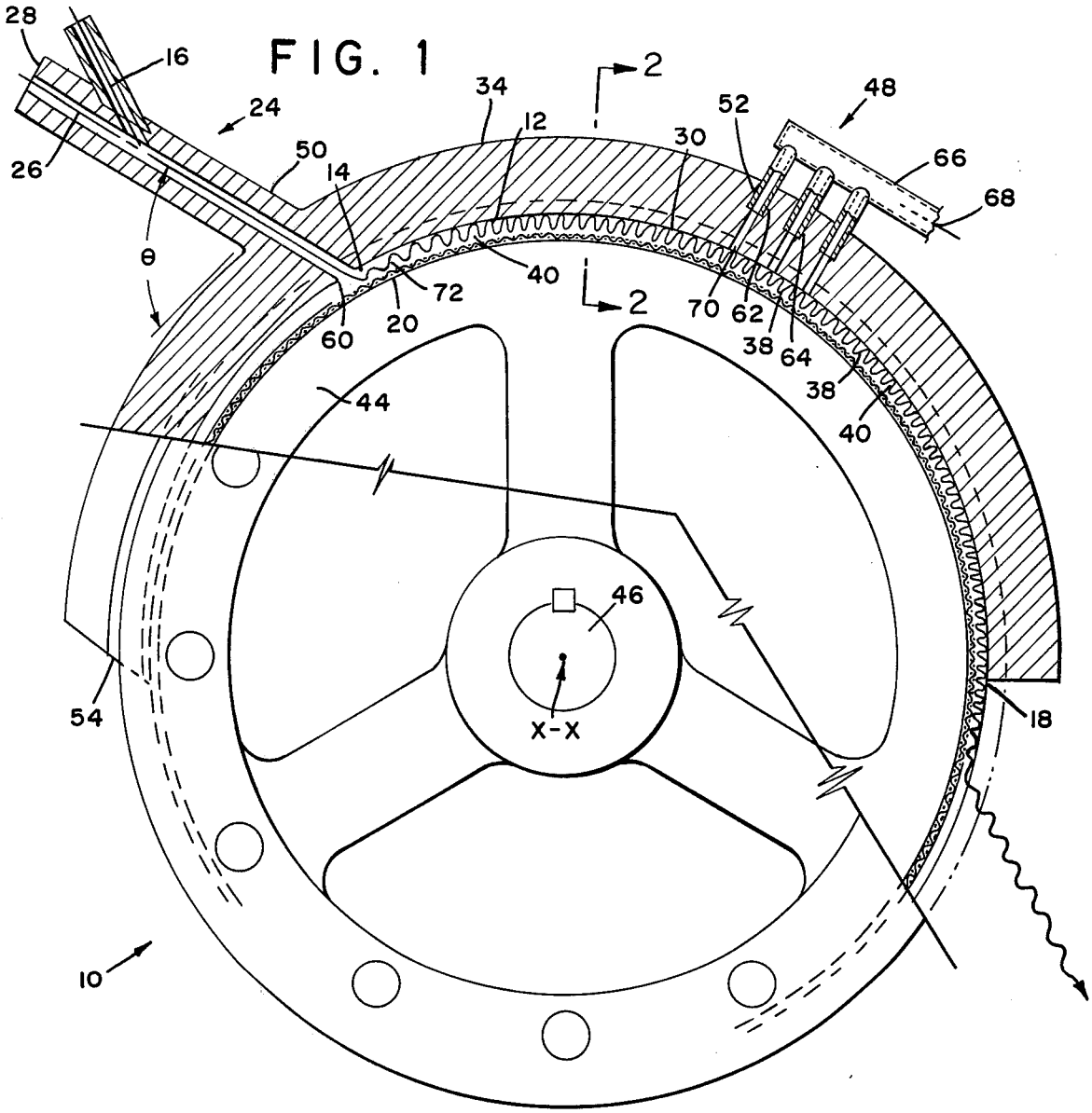
FIG. 1 is a plan view of one form of apparatus for crimping continuous filaments.
Figure 2:
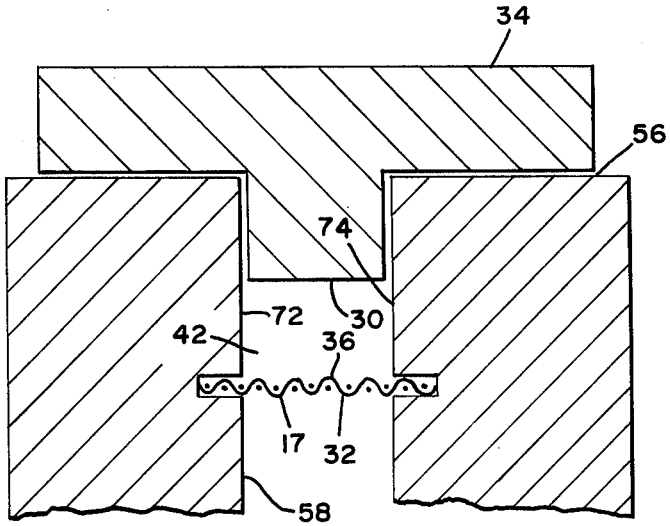
FIG. 2 is a cross section taken along the line 2—2 of FIG. 1.

Referring to FIGS. 1 and 2 of the drawings, the crimping apparatus, shown generally at 10, has a chamber 12, including an inlet opening 14 for receiving filaments 16 to be crimped and an outlet opening 18 for withdrawing the filaments after crimping. A barrier means 20, which represents a portion of a wire screen 17, as shown in FIG. 2 and described hereinafter, is disposed within the chamber 12 adjacent inlet opening 14. Continuous filaments 16, typically in the form of yarn, enter inlet 22 of fluid directing means, shown generally at 24. A heated fluid 26, preferably steam or other heated fluid, such as heated air, nitrogen, carbon dioxide and the like, having a temperature of about 100 to 350 and preferably about 150 to 300 and a pressure of about 10 to 500 psig and preferably about 20 to 300 psig. enters fluid inlet 28 (shown with a portion broken away) and forces filaments 16 through tube of fluid directing means 24 into contact with barrier means 20, the force of contact being sufficient to initiate crimping of the filaments 16. Upon contact with barrier means 20, the major portion of the compressible fluid passes through fluid escape means 32 and is thereby separated from the filaments 16 and expelled from the chamber 12. In order to prevent removal of incipient crimp or deformation initiated in the filaments 16 during separation of the fluid therefrom, it is necessary to prevent the filaments from being subjected to tension or drag during the period of their residence in chamber 12. The initially crimped filaments 16 are, therefore, transported through the chamber 12 by a carrier means, which comprises a surface 36 formed by screen 17 adapted for movement relative to the chamber 12 at a velocity sufficient to cause overfeeding of the filaments thereinto. Due to such overfeeding, the filaments are forced against a mass 38 thereof within a zone of compaction 40 in the chamber 12, producing crimps therein. A crimp setting means, including fluid jet heating means 48, is disposed in chamber 12 down stream of fluid directing means 24 for contacting the mass 38 of filaments 16 with one or more streams of heated fluid 52 to set the crimps. The crimped filaments emerged through outlet opening 18 of the chamber 12 in final crimped form.

Chamber 12 is defined by peripheral recess 42 (shown in FIG. 2) in drum 44 and opposing wall 30 of cover 34. The drum 44 is mounted on shaft 46 for rotation about axis *x-x*. The combined stream of fluid 26 and filaments 16 is directed through tube 50 into contact with barrier means 20 disposed in chamber 12. Rear extension block 54, connected to tube 50 by rivets, adhesive or the like (not shown), prevents filaments 16 or plugs thereof, which are inadvertently broken during residence in chamber 12 from reentering the chamber 12. Fluid streams 26, 52 are separated from filaments 16 and expelled from chamber 12 through a screen 17. Fluid streams 26, 52 can, additionally, be expelled from chamber 12 through passageways 56 formed between drum 44 and cover 34. Drum 44 is provided with discharge ports (not shown) extending radially through the drum and connecting with an annular chamber 58 under recess 42. The annular chamber 58 is separated from the recess 42 by wire screen 17 which forms the bottom of recess 42 and, together with chamber 58 and the discharge ports, comprises the fluid escape means 32. Screen 17 has a mesh size ranging from about 50 to 400, and preferably from about 100 to 325.

Barrier means 20 comprises a portion of the screen 17 adapted to intercept the compressible fluid stream from fluid directing means 24. In the apparatus shown in FIG. 1 of the drawings, the portion of screen 17 which represents barrier means 20 changes continuously as the periphery of drum 44 rotates. Alternatively, the barrier means can comprise a porous or nonporous plate (not shown) fixedly mounted on the fluid directing means 24 and projecting to a point of interception within the screen 17 inside chamber 12 and adjacent to the inlet opening 14 thereof.

Fluid directing means 24 is positioned relative to drum 44 so that the end 60 of tube 50 is in relatively close proximity to barrier means 20. The distance between end 60 and barrier means 20, as well as the cross-sectional area of the end 60, can vary depending on the velocity and temperature of the filaments and of the fluid stream, the denier of the filaments, the angle which the stream intersects the barrier means 20, the coefficient of friction of the impacting surface of barrier means 20 and the cross-sectional area of chamber 12. For relatively high speed yarn production, the cross-sectional area of end 60 should be about 0.0004 to 0.12 square inch and preferably about 0.0006 to 0.02 square inch. Generally, upon impact with the barrier means 20, fluid stream 26 has a velocity of about 300 to 1500 feet per second and a temperature of about 100° to 350° C. and a total pressure of about 10 to 500 psig; and filaments 16 have a velocity of about 200 to 22,000 feet per minute, a temperature of about 100° to 250° C., a size of about 1 to 25 deniers per filament and a yarn denier of 15 to 5,000. The coefficient of friction of the impacting surface is about 0.05 to 0.9, the angle of impact, $\phi$, is about 15° to 75°, the distance between end 60 and point of impact of fluid 26 on surface 36 is about 0.01 to 0.5 inch, and the cross-sectional area of chamber 12 is about 0.00015 to 1.00 square inch.

Preferably, fluid 26 contacts the impacting surface of barrier means 20 at a velocity of about 600 to 1500 feet per second, a total pressure of about 20 to 300 psig. and a temperature of 150° to 330° C., causing filaments having a size of about 2 to 15 deniers per filament and a yarn denier of about 21 to 2,600 to contact the impacting surface at a velocity of about 500 to 18,000 feet per minute and temperature of about 150° to 220° C. The coefficient of friction of the impacting surface is preferably about 0.2 to 0.4, the angle of impact, $\phi$, is preferably about 30° to 60°, the distance between end 60 and point of impact of fluid 26 on surface 36 is preferably about 0.02 inch to 0.30 inch, the cross-sectional of end 60 is about 0.0006 to 0.02 square inch and the cross-sectional area of chamber 12 is about 0.00075 to 0.15 square inch.

Fluid escape means 32 is located with respect to barrier means 20 so that a major portion of fluid 26 contacting barrier means 20 is separated from filaments 16 and expelled from chamber 12. The fluid escape means 32 comprises screen 17, together with exhaust chamber 58 and discharge ports (not shown), leading to a point exterior of drum 44. Alternatively, the fluid escape means 10 comprises a plurality of apertures provided in cover 34, the number and diameter of the apertures being sufficient to separate from filaments 16 and expel from chamber 12 a major portion of fluid streams 26, 52, as in the order of about 60 to 98 percent, and preferably about 70 to 95 percent thereof.

Referring again to FIGS. 1 and 2, filaments 16 entering compaction zone 40 impinge against previously advanced filaments (mass 38) which has not been withdrawn due to the greater feed rate of filament 16 to zone 40 in comparison to the rate at which the filaments are removed from the zone. As a result of this overfeed further crimp is imparted to the filament 16.

Crimps imparted to the filaments 16 are set by a crimp setting means. Such means can comprise a fluid jet heating means 48, including at least one passageway 62, and preferably a plurality of passageways 64, as in the order of about 4 to 60 passageways, disposed in cover 34 for communication with chamber 12 downstream from inlet opening 14. Heated fluid entering the vessel 66 travels through at least passageway 62 and preferably passageway 64 into chamber 12 in the form of a stream. The passageways are positioned in cover 34 so that the streams of fluid enter compaction zone 40 contacting the mass 38 of filaments 16 and setting the crimps therein. The temperature, volume, velocity and pressure of the second stream of fluid 52 can vary depending on the denier of the filaments, the cross-sectional area of chamber 12, the rotational velocity of drum 44, and the angle of which the second stream intersects the mass 38. For relatively high speed yarn production, as in the order of about 10 to 500 feet per second, the cross-sectional area of the end 70 of the passageway 62 of fluid jet heating means 48 should be about 0.0001 to 0.040 square inch. Generally upon contact with the mass 38 of filaments 16, the second stream of fluid 52 has a velocity of about 100 to 1500 feet per second and a temperature of about 100° to 350° C. and a total pressure of about 1 to 100 psig; filaments 16 have a velocity of about 200 to 22,000 feet per minute, a temperature of about 100° to 250° C., a denier of about 1 to 25 denier per filament and a yarn denier of about 15 to 5,000; the cross sectional area of chamber 12 is about 0.00015 to 1.00 square inch. Preferably, the second stream of fluid 52 contacts the mass 38 at a velocity of about 500 to 1500 feet per second, a total pressure of about 2 to 80 psig and a temperature of about 150° to 300° C., setting the crimps in filaments having a denier of about 2 to 15 per filament and a yarn denier of about 15 to 2,600. The angle of impact, $\theta$, is preferably about 30° to 150°, the cross-sectional area of end 70 is about 0.006 to 0.030 square inch, the cross-sectional area of chamber 12 is about 0.00075 to 0.15 square inch and the center to center distance between inlet opening 14 and end 70 of passageway 62 is about 0.5 to 30 inches. Preferably, the fluid jet heating means 48 includes a plurality of passageways, as in the order of 2 to 200 and preferably 4 to 60.

After contact with the second stream of heated fluid 52, the crimped filaments move in recess 42 for about one quarter to three quarter of a rotation of drum 44 to outlet opening 18 where they are taken up on conventional bobbins using conventional winders and the like. In this embodiment, the carrier means for transporting filaments 16 through chamber 12 is comprised of a surface including walls 72, 74 and screen 17 of recess 42 and wall 30 of cover 34. The carrier means 34 can alternatively be comprised of screen 17 solely. Carrier velocity varies inversely with the surface area thereof, and the crimp frequency desired. Generally the velocity of the carrier means shown in FIGS. 1 and 2 is about 1 to 10 percent of the velocity of filaments 16 at inlet 14. By varying the velocity of the carrier means, the reisdent time of filaments 16 in compaction zone 40 is controlled to produce permanency of crimp and dying uniformity of the textured filaments 16.

The apparatus 10 which has been disclosed herein can be modified in numerous ways without departing from the scope of the invention. As previously noted the configuration of chamber 12 can be linear or curvilinear. Barrier means 20 can be porous or nonporous and can comprise a stationary noncontinuous or movable continuous impacting surface 72. Each of peripheral recess 42 of drum 44 and cover 34 can be constructed entirely of fine wire mesh or screen to provide for escape of compressible fluid through all sides of chamber 12.

Figure 3:
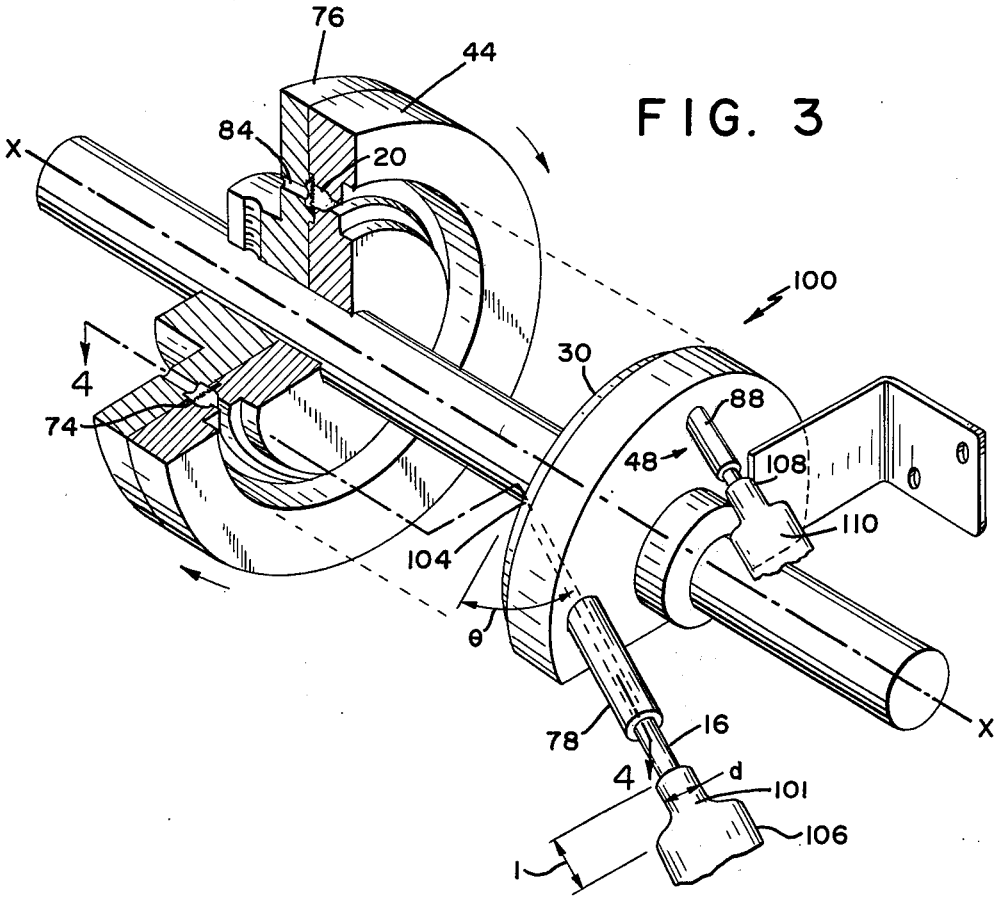
FIG. 3 is a perspective view illustrating another form of apparatus for carrying out the method of this invention, the cover and chamber of the apparatus having a disengaged position, and the chamber being partially broken away to show the construction thereof.
Figure 4:
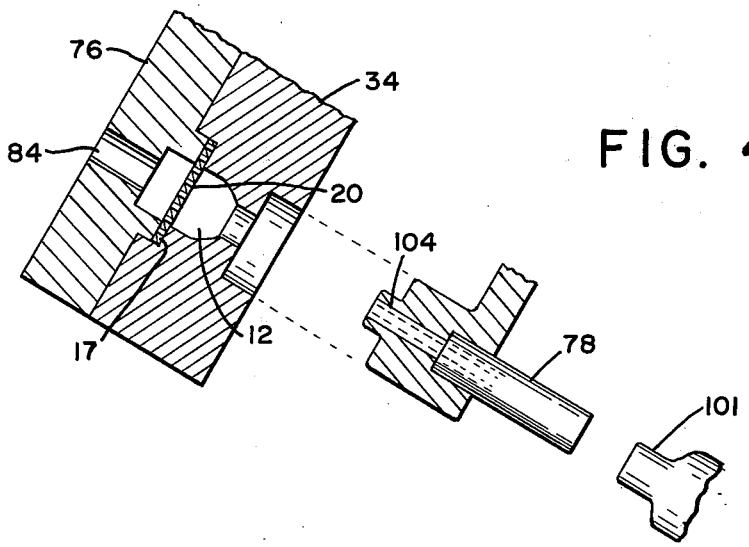
FIG. 4 is a section taken along the line 4—4 of FIG. 3.

As shown in FIGS. 3 and 4, barrier means 20 can be a perforated plate 74 forming a wall of recess 42 in drum 44 opposite wall 30 of cover 34. The drum 44 is mounted on shaft 80 which rotates on bearings (not shown) in block 76 about axis *x-x*. The first stream of fluid 26 supplied to energy tube 78 from nozzle 101 of conduit 106 carries filaments 16 through energy tube 78 into contact with barrier means 20 disposed within chamber 12 in the manner previously set forth in connection with FIGS. 1 and 2. Fluid 26 is separated from filaments 16 and expelled from chamber 12 through passageway 84 in block 76. Drum 44 rotates about *x-x*, transporting filament 16 through chamber 12. At least a second stream 52 of heated fluid supplied into nozzle 108 by conduit 110 enters chamber 12 through tube 88 of fluid jet heating means 48. The filaments 16 emerge from chamber 12 through an outlet opening (not shown) in the matter set forth in connection with FIGS. 1 and 2. These and other modifications are intended to fall within the scope of the invention as defined by the subjoined claims.

While the method and apparatus of this invention have been described herein primarily in terms of texturizing thermoplastic filaments, especially polyester filaments, it is clear that the method and apparatus of the present invention can also be used to crimp a wide a variety of other filaments, such as filaments composed of homopolymers and copolymers of the following materials: $\epsilon$-aminocaproic acid, hexamethylene adipamide, ethylene terephthalate, tetramethylene terephthalate and 1,4-cyclohexylenedimethylene terephthalate. In addition, the filaments 16 can be composed of polyacrylonitrile, polypropylene, poly-4-aminobutyric acid and cellulose acetate.

In operation, yarn in the form of continuous filaments 16 is fed by aspiration into a stream of fluid 26. Fluid directing means 24 directs the fluid 26 containing filaments 16 into contact with barrier means 20, disposed within chamber 12 to initiate crimping of the filaments 16. Fluid escape means 32 separates the major portion of the compressible fluid 26 from filaments 16 and expels it from chamber 12 the filaments 16 are transported through the chamber by continuous movement of a surface therein to cause overfeeding of the filaments 16 into the chamber. The filaments 16 are subsequently forced against a mass 38 thereof within a zone of compaction 40, producing crimps therein. One or more streams 28 of heated fluid are directed by fluid jet heating means 48 into contact with the mass 38 of filaments 16 to set the crimps. The filaments emerge from the chamber 12 in crimped form and are wound onto packages.

The following examples are presented in order to provide a more complete understanding of the invention. The specific techniques, conditions, materials and reported data set forth in illustrate the principles and practice of the invention are exemplary and should not be construed as limiting the scope of the invention.

EXAMPLE 1

A 150 denier, 34 filament polyethylene terephthalate yarn was texturized using the apparatus of FIGS. 1 and 2. The filaments were aspirated through tube 50 of fluid directing means 24 at a velocity of 4500 feet per minute with steam entering fluid inlet 28 at a temperature of 280° C. and a pressure of 150 psig. Fluid inlet 28 had a internal diameter of 0.055 inch and a length of 0.5 inch. Tube 50 had an internal diameter of 0.060 inch and a length of 3.5 inches, and was inclined at an angle, $\phi$, of 60° with respect to a line tangential to the surface of barrier means 20. The rotational speed of drum 44 was about 16 revolutions per minute. The barrier means was a brass plate having a thickness of 0.012 inch and containing a plurality of apertures. Each of the apertures had a diameter of 0.013 inch. The apertures were separated by a center to center distance of 0.016 inch and were sufficient in number to provide the plate with 52 percent open area. Chamber 12 had a width of 0.103 inch and a depth of 0.030 inch. Drum 44 was rotated so that the carrier means had a surface velocity of about 48 feet per minute. The cross-sectional area, $A_c$, of the chamber was 0.003 square inch. Fluid jet heating means 48 included 21 passageways disposed in cover 34 in communication with chamber 12. Each of the passageways had an internal diameter of 0.026 inches. The passageways were equally spaced 0.25 inch apart circumferentially of cover 34 commencing 1 inch downstream of end 60 of fluid directing means 24. Steam supplied to the passageways be vessel 66 contacted mass 38 of filaments 16 at a pressure of 8 psig and a temperature of 280° C.

The filaments 16 entered energy tube 50 and were directed into contact with barrier means 20. Contact between the yarn-containing stream and the barrier means 20 initiated crimping of the filaments. The carrier means transported the yarn to a zone of compaction 40 within chamber 12, whereupon mass (plug) 38 of yarn formed within the zone 40, causing further crimping of the filaments. The packing density of the plug 38 within the chamber 12 was computed to be 53 percent in accordance with the equation: packing density equals $KV_i/A_c$. $V_c$, where K is a constant which is equal to 0.0000175 square inch for polyester yarn of 150 denier and density of 1.38 grams per cubic centimeter, $V_i$ is the yarn inlet speed in feet per minute, $A_c$ is the cross-sectional area of chamber 12 in square inches and $V_c$ is the barrier surface speed in feet per minute. The yarn emerged in crimped form from the chamber through outlet opening 18 and was taken up onto conventional parallel wound packages rotated on conventional winders by means of a pair of rollers (not shown). The speed of the winder was approximately 3600 feet per minute.

The average skein shrinkage level of the textured yarn was then determined. The skein shrinkage test consisted of winding the textured yarn into a skein and hanging the skein under no load in a hot air oven at 145° C. for 5 minutes. The skein was removed from the oven and a 0.0016 gram per denier weight was hung on it. The new skein length was measured ($L_f$). The percent of skein shrinkage was then calculated from the initial skein length ($L_o$) and the final skein length ($L_f$) in accordance with the equation $(L_o\text{-}L_f)L_o$. Photomicrographs made of 20 filaments selected at random from the textured yarn showned a crimp count of 44.3 crimps per inch and a crimp amplitude of 0.016 inch. The developed skein had an had an average skein shrinkage level of 40 percent, indicating that the textured yarn was suitable for use in manufacture of wearing apparel.

The textured yarn produced in accordance with Example 1 was knitted on a Lawson-Hemphill Fiber Analysis Knitter having a 54 gauge head 220 needles, a diameter of 3.5 inches and 36 inches per course. The knitted fabric, when dyed, showed good uniformity and was free from streaks. In addition, the fabric had a soft texture, dimensional stability and pleasing appearance.

EXAMPLE 2

Polyethylene terephthalate yarn was extruded and processed using the method and apparatus described in Example 1, except that fluid jet heating means 48 was not employed. The developed skein had a denier of 186 and a skein shrinkage level of 20 percent, indicating that the yarn was not suitable for use in manufacture of wearing apparel.

EXAMPLE 3

Polyethylene terephthalate yarn was extruded and processed using the method and apparatus described in Example 2, except that the fluid stream 26, 28 entered energy tube 50 at a pressure of 150 psig and a temperature of 360° C. The texturized yarn had a denier of 229. In addition, the texturized yarn was non-uniform, contained many broken filaments and exhibited considerable fusion among the filaments. Further, the texturized yarn had a skein shrinkage level of 35 percent, indicating that the yarn was not suitable for use in manufacture of wearing apparel.

Having thus described the invention in rather full detail, it will be understood that these details need not be strictly adhered to but that various changes and modifications may suggest themselves to one skilled in the art. It is accordingly intended that all matter contained in the above description and shown in the accompanying drawings shall be interpreted as illustrative and not in a limiting sense.

What is claimed is:

1. Apparatus for crimping continuous filaments comprising:

a. a chamber having a moveable, perforate yarn receiving means disposed therein;

b. fluid directing means having an angular disposition relative to said yarn receiving means for directing a stream of heated fluid containing said filaments into contact with said yarn receiving means to initiate crimping thereof, the angle of disposition being such that impingement of said filaments occurs within said chamber, said yarn receiving means being adapted to separate the major portion of said fluid from said filaments and to expel it from said chamber and to provide a continuously moving surface associated with said chamber to cause overfeeding of said filaments into said chamber, said filaments being forced against a mass thereof within said chamber to produce crimps therein; and c. crimp setting means, including fluid jet heating means disposed in said chamber downstream of said fluid directing means, for contacting said mass of filaments with at least a second stream of heated fluid to set the crimps, whereby said filaments emerge from the chamber in crimped form.

2. Apparatus as recited in claim 1, wherein said chamber has a curvilinear configuration.

3. Apparatus as recited in claim 1, wherein said yarn receiving means has a coefficient of friction of about 0.05 to 0.9.

4. Apparatus as recited in claim 1, wherein said yarn receiving means is a screen having a mesh size ranging from about 50 to 400.

5. Apparatus as recited in claim 1, wherein said chamber has a cover and said fluid jet heating means includes at least one passageway disposed in said cover.

6. Apparatus as recited in claim 5, wherein said passageway had an end in communication with said chamber and the center-to-center distance between said end and said inlet opening is about 0.5 to 30 inches.

7. Apparatus as recited in claim 6, wherein said fluid jet means includes a plurality of passageways.

8. Apparatus as recited in claim 6, wherein the cross-sectional area of said passageway end is about 0.0001 to 0.040 square inch.

9. Apparatus as recited in claim 1, wherein said yarn receiving means is a plate containing a plurality of apertures, the number of apertures being sufficient to separate from said filaments and expel from said chamber about 60 to 98 percent of said fluid.

10. A method of crimping continuous filaments comprising the steps of:

a. feeding said filaments by aspiration into a stream of heated fluid;

b. directing said stream containing said filaments into contact with a movable, perforate yarn receiving means disposed within a chamber, the contact occuring within said chamber and the force of contact being sufficient to initiate crimping of said filaments;

c. separating a major portion of said fluid from said filaments and expelling it from said chamber;

d. transporting said filaments through said chamber by continuous movement of a surface therein at sufficient velocity to cause overfeeding of said filaments into said chamber said filaments being forced against a mass thereof within said chamber to produce crimps therein;

e. contacting said mass with one or more streams of heated fluid to set the crimps; and f. removing said filaments in crimped form from said chamber.

11. A method as recited in claim 10 wherein said filaments contact said yarn receiving means at an angle of impact of about 15° to 75°.

12. A method as recited in claim 10 wherein said filaments contact said yarn receiving means at a velocity of about 600 to 12,000 feet per minute.

13. A method as recited in claim 10 wherein said streams of fluid are compressible.

14. A method as recited in claim 10, wherein the mass is contacted with a plurality of streams of fluid.

15. A method as recited in claim 10, wherein each of said streams of fluid has a temperature of about 150° to 300° C.

16. A method as recited in claim 10 wherein said filaments are composed of polyester.

17. A method as recited in claim 11 wherein said filaments are composed of material selected from the group consisting of poly 1,4-cyclohexylenedimethylene terephthalate, polyethylene terephthalate, polyhexamethylene adipamide, poly ϵ-aminocaproic acid, polypropylene, cellulose acetate and cellulose tri-acetate.

18. A method as recited in claim 10 wherein said filaments contain in excess of 40 crimps per inch and a skein shrinkage level of at least about 40 percent when removed from said chamber.

* * * * *